US005251770A

United States Patent [19]

Bartley et al.

[11] Patent Number: 5,251,770

[45] Date of Patent: Oct. 12, 1993

[54] CONTAINER AND PRESSURE SEALING CLOSURE COMBINATION

[75] Inventors: Harold D. Bartley, Springfield; William R. Gaiser, Spring Valley, both of Ohio

[73] Assignee: Broadway Companies, Inc., Dayton, Ohio

[21] Appl. No.: 879,768

[22] Filed: May 6, 1992

[51] Int. Cl.[5] ..... B65D 53/00

[52] U.S. Cl. ..... 215/270; 215/271; 215/307; 215/305; 220/240; 220/366; 220/360; 220/379

[58] Field of Search ..... 215/270, 271, 307, 305, 215/260, 254; 220/240, 379, 212, 500, 366, 360, 266, 269

[56] References Cited

U.S. PATENT DOCUMENTS

| | | | |
|---|---|---|---|
| 279,216 | 6/1883 | Berlien . | |
| 328,329 | 1/1929 | Bramwell . | |
| 657,982 | 4/1949 | Wyer et al. . | |
| 1,263,490 | 4/1918 | Wadsworth . | |
| 1,598,085 | 4/1925 | Kirschmann . | |
| 1,810,630 | 6/1931 | Tapp . | |
| 2,057,972 | 10/1936 | Pieck . | |
| 2,503,944 | 4/1950 | Frascari . | |
| 2,669,369 | 2/1954 | Towns | 215/305 |
| 3,244,308 | 4/1966 | Esposito, Jr. | 215/270 |
| 3,368,707 | 2/1968 | Johnson et al. | 215/254 |
| 3,402,844 | 9/1968 | Chin . | |
| 3,415,403 | 12/1968 | Bardell . | |
| 3,417,893 | 12/1968 | Lieberman . | |
| 3,420,397 | 1/1969 | Miller | 220/366 X |
| 3,430,795 | 3/1969 | Laufer . | |
| 3,466,702 | 9/1969 | Stenger . | |
| 3,478,913 | 11/1969 | Kemp . | |
| 3,537,606 | 6/1969 | Solowey . | |
| 3,583,591 | 6/1969 | Hayashida . | |
| 3,672,527 | 6/1972 | Bly | 215/270 X |
| 3,785,519 | 1/1974 | Huh | 215/305 X |
| 3,817,677 | 6/1974 | Seefluth . | |
| 3,825,144 | 7/1974 | Wiedmer . | |
| 3,843,016 | 10/1974 | Bornhorst et al. . | |

(List continued on next page.)

FOREIGN PATENT DOCUMENTS

| | | |
|---|---|---|
| 34758 | 9/1934 | Netherlands . |
| 292614 | 8/1929 | United Kingdom . |
| 328329 | 4/1930 | United Kingdom . |
| 657982 | 10/1951 | United Kingdom . |

*Primary Examiner*—Allan N. Shoap
*Assistant Examiner*—Paul A. Schwarz
*Attorney, Agent, or Firm*—Thompson, Hine and Flory

[57] ABSTRACT

A container and pressure sealing closure combination in which the closure includes a rim portion engaging the mouth of the container, a substantially rigid central portion and an annular toggle portion pivotally connected to and interconnecting the rim portion and central portion, whereby upward movement of the central portion in response to internal pressure of the contents of the container pivots the toggle portion to urge the rim portion substantially radially outwardly against the mouth, thereby effecting a seal. In a preferred embodiment, the inner surface of the container mouth includes a plurality of axially-extending channels for conducting pressurized gaseous contents of the container between the closure and the container to the ambient. The outer surface of the mouth includes an annular recess which receives a plurality of radially inwardly projecting ribs on the rim portion, thereby effecting engagement between the closure and container. The closure includes a tab which is pivoted upwardly to remove the closure from the container, and the rim portion includes a plurality of sets of radially extending slots which fracture when the tab is pivoted upward, thereby preventing reattachment of the closure. Also in the preferred embodiment, the container includes an annular base shaped to receive the closure.

27 Claims, 5 Drawing Sheets

U.S. PATENT DOCUMENTS 3,868,039 2/1975 Holbrook .
3,980,746 9/1976 Carrow .
4,040,538 8/1977 Gerson ..... 220/379 X
4,166,552 9/1979 Faulstich .
4,251,002 2/1981 Middleton et al. .
4,328,538 12/1980 Manwiller .
4,333,904 6/1982 Jakobsen .
4,374,878 2/1983 Jakobsen et al. .
4,616,761 10/1986 Nolan ..... 215/271
4,660,735 4/1987 Peschardt et al. .
4,694,971 9/1987 Elsmo et al. .
4,771,905 9/1988 Perne et al. ..... 215/270
4,784,280 11/1988 Breuer et al. .
4,798,300 1/1989 Ghosh et al. .
4,890,726 1/1990 Wissmann .
4,894,268 1/1990 Greenwood et al. .
4,921,113 5/1990 Dubach .
4,934,554 6/1990 Edwards .
4,941,815 7/1990 Julian .
4,951,829 8/1990 Hsu ..... 215/305 X
5,103,990 4/1992 Irwin ..... 215/240 X
5,119,955 6/1992 Granofsky ..... 220/266 X

CONTAINER AND PRESSURE SEALING CLOSURE COMBINATION

BACKGROUND OF THE INVENTION

The present invention relates to closure and container combinations, and more particularly, to closures which utilize the internal pressure of the container contents to effect a seal.

Due to cost and safety considerations, it is desirable to fabricate carbonated beverage containers from polyethylene terephthalate (PET). Containers for carbonated beverages made from PET are blow molded in mass quantities from preforms. An advantage of using PET is that it is easily recyclable. However, with present designs, the carbonated beverage container itself is made of PET and includes a threaded mouth which receives a cap made of aluminum. The aluminum closure or cap includes a ring of perforations which forms a line of separation so that, when removed from the container, the cap leaves behind a thin aluminum ring.

Accordingly, at some point in the recycling process, it is necessary to separate the aluminum ring from the PET material. This separation step would be eliminated if the entire container-closure combination could be made of PET. Since PET has a different strength than aluminum, it is necessary to design a different closure shape. One example of such a closure and container is disclosed in Wiedmer U.S. Pat. No. 3,825,144. That patent discloses a container closure for sealing bottles having pressurized contents and includes a sealing member having a deformable disk portion with an outwardly concave shape. The disk portion deforms in response to the internal pressure of the container contents. However, such a flexible closure is unsuitable for fabrication of PET, since the internal pressure of a typical carbonated beverage container is not sufficiently great to deform the entire surface of such a closure.

Accordingly, there is a need for a container and closure design suitable for a carbonated beverage in which the closure can be made of a flexible plastic material such as PET. Further, a disadvantage with such closures is that they lack means for the gradual release of pressure within the container. As a result, there is a risk that, when opening such a prior art closure, the closure is propelled from the container by the pressure from the contents within the container; or that the gaseous contents of the container. Accordingly, there is a need for a container and closure mechanism in which the internal pressure generated by the contents of the container effects a seal and in which means are provided for the gradual equalization of pressure within the container during opening of the closure.

SUMMARY OF THE INVENTION

The present invention is a container and pressure sealing closure combination which can be made entirely of PET and in which the closure utilizes the pressure generated by the contents of the container to effect a seal. The closure is shaped to cover the annular mouth of the container and includes a rim portion engaging the mouth, a substantially rigid central portion and an annular toggle portion interconnecting the rim and central portions. Upward movement of the central portion in response to internal pressure from the contents of the container pivots the toggle portion to urge the rim portion substantially radially outwardly against the mouth, thereby effecting a seal. In addition, the mouth of the container includes an outer, annular recess and the rim portion of the closure includes ribs which engage the recess and thereby provide an additional mechanism of attachment of the closure to the container.

The mouth of the container includes an inner periphery of axially extending channels which are positioned at the interface between the rim portion and mouth. When the closure is deformed during removal from the container, the pressurized gas within the container is permitted to escape to the ambient through these channels, which regulate the egress of gases from the container and prevent an explosive burst of gas during the opening procedure.

In order to facilitate the removal of the closure from the container, a tab is included which projects radially from the rim of the closure. Accordingly, removal of the closure is effected by pivoting the tab relative to the closure which deforms the closure and allows the pressurized gases within the container to escape and thereby eliminates the sealing mechanism created by the toggle portion against the rim portion. In a preferred embodiment, the closure includes sets of radially extending slots which fracture when the closure is deformed during the opening procedure. This fracturing facilitates the further deformation of the closure and its removal from the container. In addition, the fracture lines resulting from the fractured slots provide a readily visible indicator that the container has been opened, and further, prevents the resealing of the container with that particular closure.

Also in a preferred embodiment, the container includes a pedestal or base which comprises an annular ring. The ring is shaped to receive the closure within its inner periphery in a slight interference fit. Consequently, when removed from the retainer, the closure can be stored in the base and the container and closure disposed of as a unit.

In an alternate embodiment, the toggle portion is modified to include a wedge component which extends radially outwardly and upwardly. When the central portion is deflected by the pressurized contents of the container, the wedge portion is pivoted into contact with the rim portion to effect the seal.

Accordingly, it is an object of the present invention to provide a container and closure combination which can accommodate pressurized contents of a container, such as a carbonated beverage; a combination which can safely hold pressurized contents and be made entirely of PET; a combination in which the internal pressure generated by the container contents is used to effect the seal between the container and closure; a combination in which the closure engages the container so that release of pressurized gases from the container is safely regulated during opening; a combination in which the closure includes slots that provide fracture lines during opening to facilitate opening and evidence that the closure has been removed from the container; a combination in which the container includes a base adapted to receive the closure so that the closure may be stored safely in the base after removal from the container; and a combination in which the container and closure are relatively easy to fabricate and assemble.

Other objects and advantages of the present invention will be apparent from the following description, the accompanying drawings and the appended claims.

DETAILED DESCRIPTION

Figure 1:
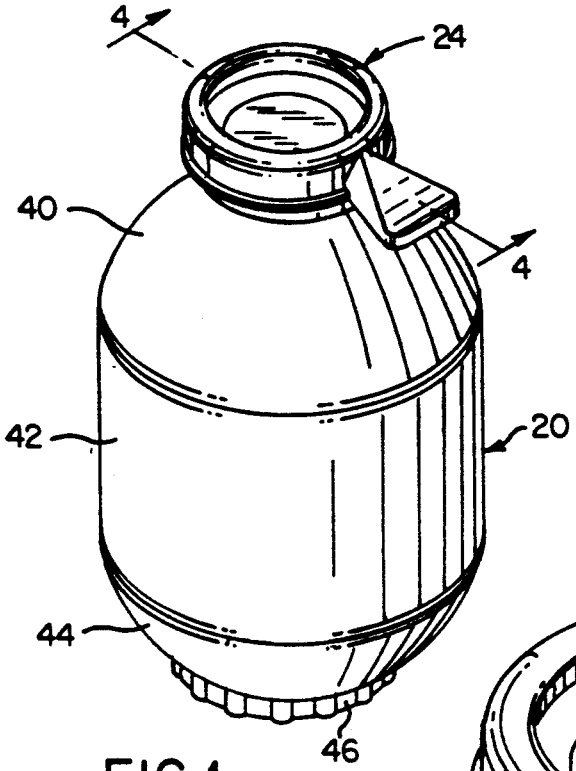
FIG. 1 is a perspective view of a preferred embodiment of the container and pressure-sealing closure combination of the present invention.
Figure 3:
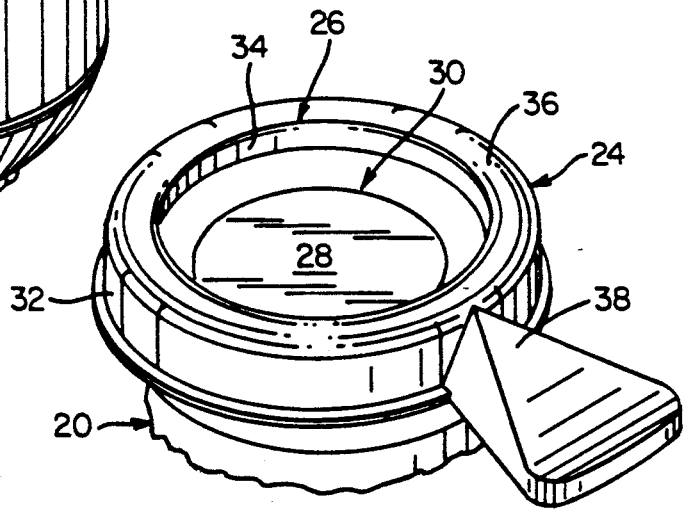
FIG. 3 is a detail showing the attachment of the closure to the container of FIG. 1.
Figure 2:
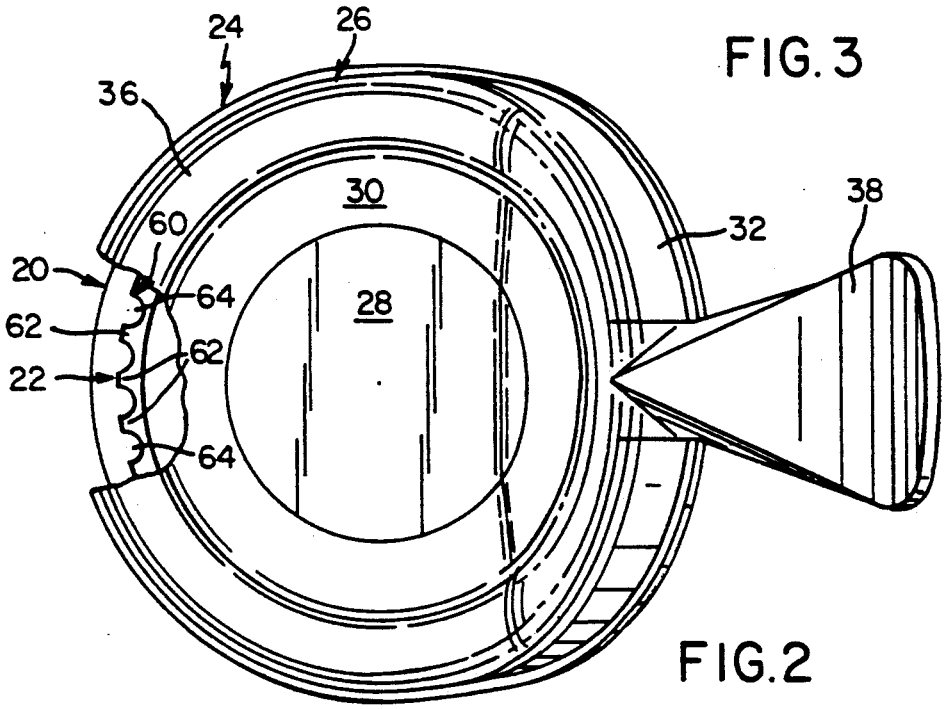
FIG. 2 is a perspective view of the closure of the combination of FIG. 1 which is partially broken away to reveal the shape of the container mouth.

As shown in FIG. 1, 2 and 3, the container and pressure sealing closure combination of the present invention includes a generally cylindrically shaped container 20 having a mouth 22 which is sealed by a closure 24. Both the container 20 and closure 24 are made of a recyclable material, preferably polyethylene terephthalate (PET).

The closure 24 includes a raised rim portion 26, a circular central portion 28 and a toggle portion 30 which interconnects the rim portion and central portion. The rim portion 26 includes a vertically-extending, radially outer wall 32, a vertically-extending, radially inner wall 34 and a substantially horizontally-extending top wall 36 which interconnects the inner and outer walls. A tab 38 is formed integrally with and extends radially outwardly from the outer wall 32.

The container 20 includes an upper frustoconical portion 40, a central cylindrical portion 42 and a lower frustoconical portion 44, which terminates in an annular base 46. The upper frustoconical portion 40 terminates upwardly in the mouth 22 (see FIG. 4).

Figure 4:
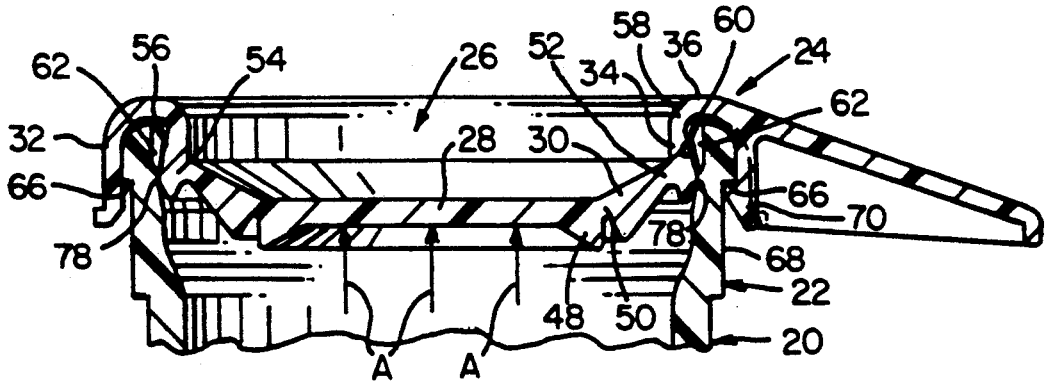
FIG. 4 is a detail side elevation taken at line 4—4 of FIG. 1.
Figure 5:
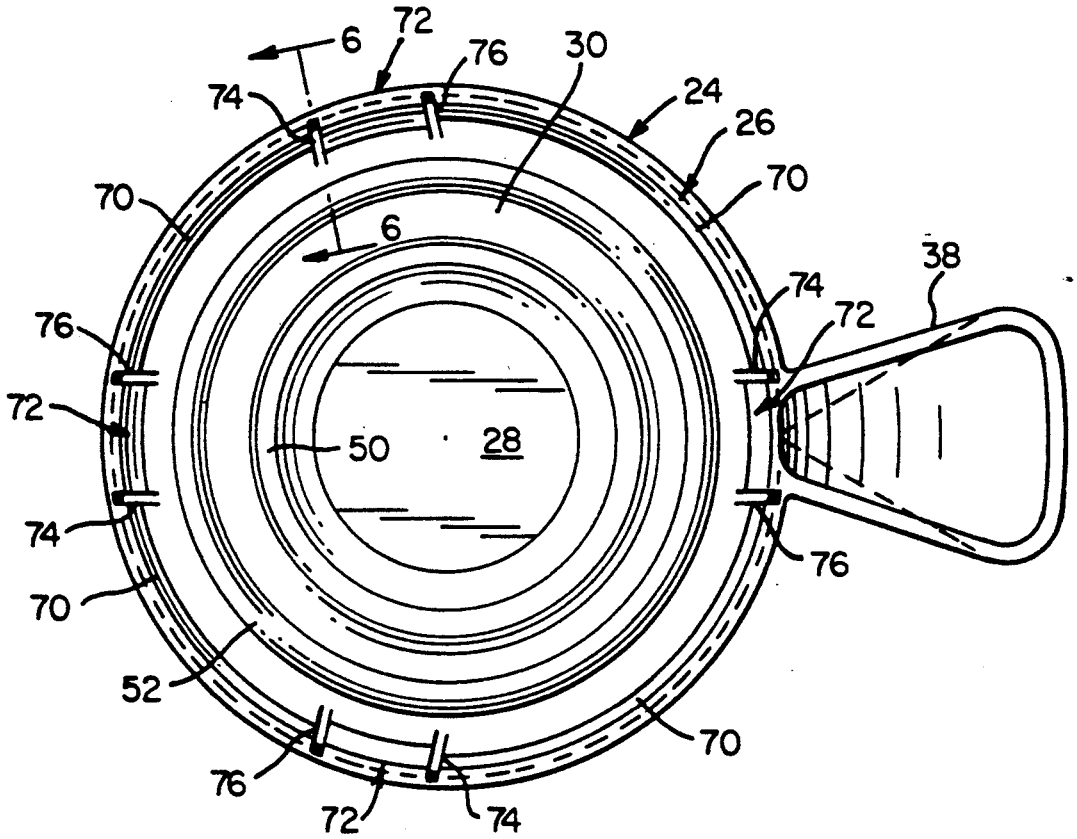
FIG. 5 is a bottom plan view of the closure of FIG. 1.

As shown in FIGS. 4 and 5, the central portion 28 includes a thickened peripheral rim 48 which is connected to the toggle portion 30 by a relatively thin hinge 50. Similarly, the toggle portion 30 is connected to the inner wall 34 by a second relatively thin hinge portion 52. Consequently, the toggle portion pivots relative to the central portion 28 and inner wall 34. Further, the toggle portion 30 is angled upwardly relative to the central portion 28, so that the central portion and toggle portion together form a substantially dished shape.

Figure 6:
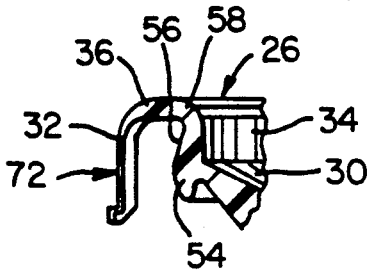
FIG. 6 is a detail side elevation in section taken at line 6—6 of FIG. 5.

The inner wall 34 of the rim portion 26 is thickened at its lower edge 54 (see also FIG. 6), and the outer face 56 of the inner wall 34 tapers radially inwardly away from the mouth 22. The junction 58 of the inner wall 34 and top wall 36 is relatively thin to facilitate flexing during removal of the closure 24 from the mouth 22. Conversely, the radially inner face 60 of the mouth 22 tapers inwardly and corresponds generally in the angle of taper with the outer face 56 of the inner wall 34. Further, the inner face 60 includes a plurality of axially extending slots 62, substantially equally spaced about the inner periphery of the mouth 22 (see also FIG. 2). The presence of the slots provides channels for the egress of the pressurized gas within the container 20. The slots 62 are formed between a series of spaced ribs 64 formed on the inner face 60 of the mouth 22.

As shown in FIG. 4, the mouth 22 includes an undercut forming an annular recess 66 which extends about the periphery of the outer face 68 of the mouth 22. The outer wall 32 of the rim portion 26 includes a radially inwardly projecting rib 70 which is shaped to engage the recess 66. As shown in FIG. 5, the rib 70 extends substantially continuously about the inner periphery of the outer wall 32, being interrupted only by four fracture portions, generally designated 72. The fracture portions 72 coincide with the tab 38, at a position on the rim portion 26 diametrically opposite the tab, and two intermediate locations which are positioned at angles of approximately 77' along the periphery of the rim portion 26 from the fracture portion opposite the tab 38. Each fracture portion 72 includes a pair of spaced slots 74, 76 formed in the undersides of the outer wall 32 and top wall 36. The portion of the outer wall 32 extending between the slots 74, 76 lacks the rib 70, except for the fracture portion 72 associated with the tab 38.

As shown in FIG. 4, the closure 24 is sealed against the mouth 22 of the container 20 in part by pressure exerted upon the closure 24 by the pressurized contents (not shown) of the container. The internal pressure of the container 20, which is above atmospheric, exerts an outward force on the central portion 28 of the closure 24 in the direction of arrows A. The slight upward movement of the central portion 28 in response to the force causes the central portion to pivot the toggle portion 30 outwardly against the inner wall 34 of the rim portion 26. This, in turn, urges the outer face 56 of the inner wall 34 against the inner face 60 of the mouth 22. The inherent hoop strength of the mouth 22 will prevent deformation sufficient to allow the internal contents to force the closure 24 off of the mouth 22.

Such movement is further restricted by the reverse taper engagement between the outer face 56 of the inner wall 34 and the inner face 60 of the mouth 22. The thickened portion 54 of the inner wall 34 contacts the inner face 60 of the mouth 22 at a seal area 78 (See also FIG. 7). The seal area 78 prevents the egress of the pressurized contents of the container 20 (see FIG. 1) from escaping.

Figure 7:
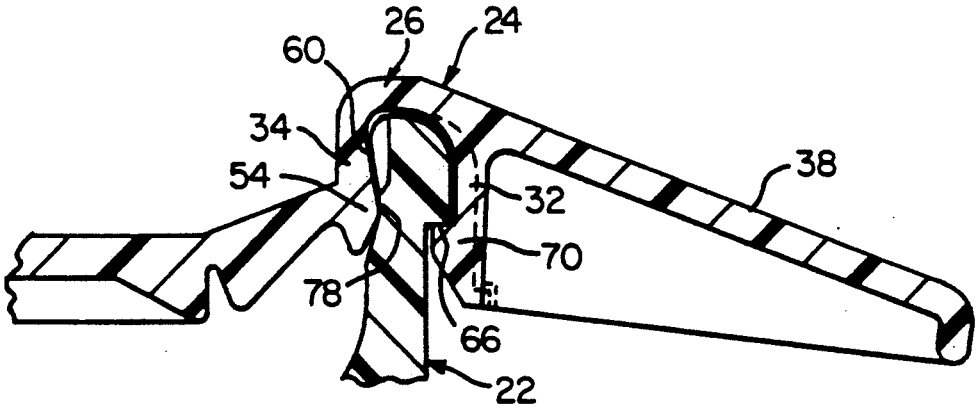
FIG. 7 is a detail side elevation in section of the closure of FIG. 1 showing the closure attached to the mouth of the container.
Figure 8:
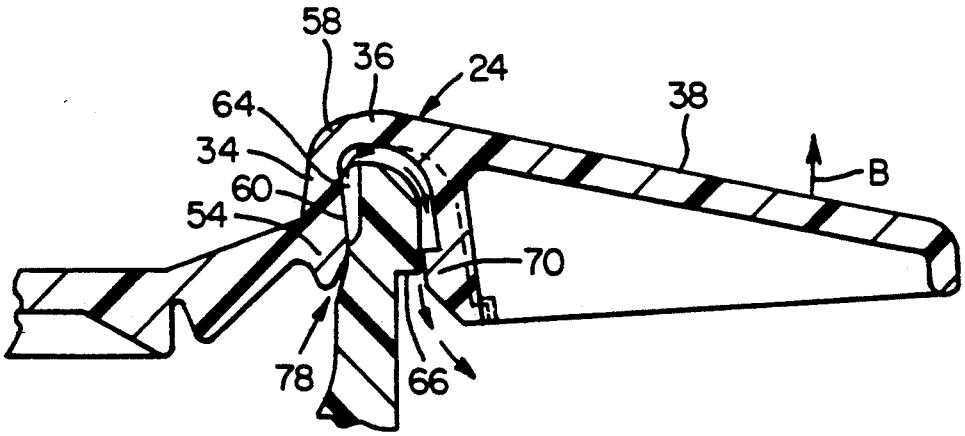
FIG. 8 is the side elevation of FIG. 7 in which the tab is pivoted to release gases from the interior of the container.
Figure 9:
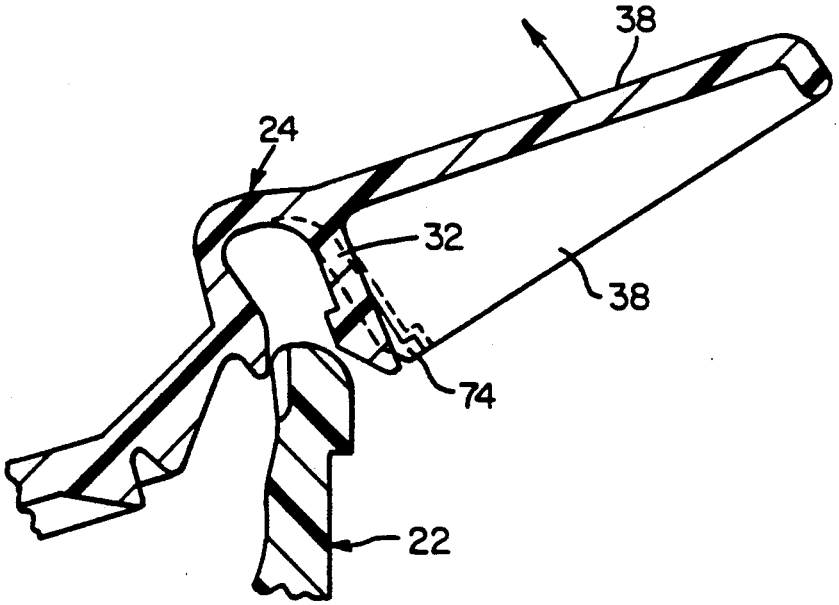
FIG. 9 is the section of FIG. 7 in which the tab has been pivoted so that the closure rim is separated from the container mouth.

The removal of the closure 24 from the mouth 22 is shown sequentially in FIGS. 7-9. As shown in FIG. 7, the closure 24 is securely mounted on the mouth 22 of the container 20 (see FIG. 1), in which the inner wall 34 of the rim portion 26 is urged against the inner face 60 of the mouth 22. Further, the ribs 70 of the outer wall 32 are in locking engagement with the recess 66 on the mouth 22.

As shown in FIG. 8, when the tab 38 is pivoted in the direction of arrow B, the rib 70 immediately adjacent to the tab 38 is disengaged from the recess 66 as the outer wall 32 and top wall 36 pivot at junction 58. The top wall 36 and inner wall 34 are, at the same time deflected away from the mouth 22 by this pivoting action. This also causes the thickened portion 54 to be displaced upwardly from the seal area 78 to the ribs 64 on the inner face 60 of the mouth 22. When in this position, the contents of the container 20 are permitted to escape through the slots 62 (see FIG. 2).

As shown in FIG. 9, further deflection of the tab 38 causes the area of the outer wall 32 to fracture along the slots 74, 76 on either side of the tab (see also FIG. 5). In removing the closure 24 from the container 22, the other fracture portions 72 will also split along their respective slots 74, 76. This partial destruction of the closure 24 prevents the reattachment of the closure and the resealing of the closure to the container 20.

Figure 10:
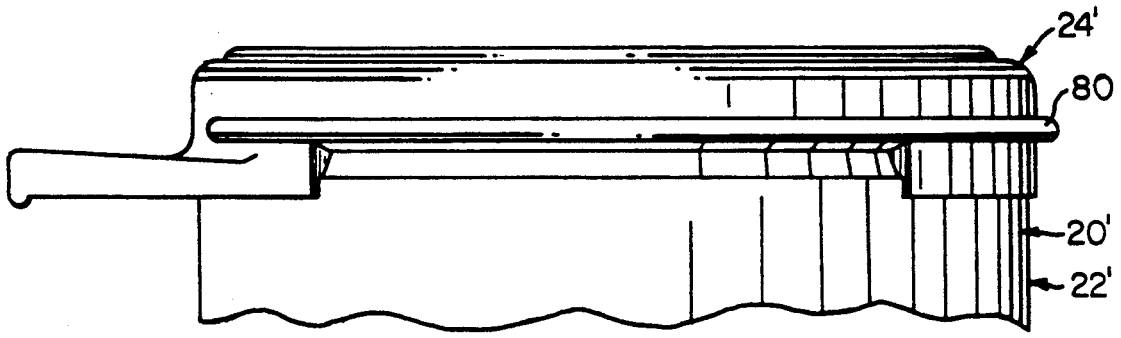
FIG. 10 is a detail side elevation of an alternate embodiment of the invention.
Figure 11:
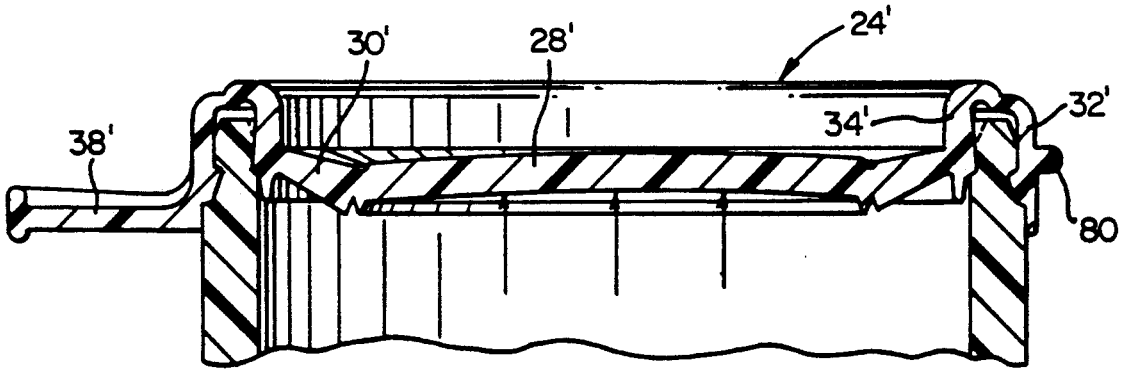
FIG. 11 is a side elevation in section of the embodiment of FIG. 10.

An alternate embodiment of the container is shown in FIGS. 10 and 11. The closure 24' is similar in construction to the closure 24 shown in FIGS. 1-9. However, the outer wall 32' is somewhat thinner than the inner wall 34', and is strengthened by an outer rib 80, which extends substantially around the outer periphery of the closure 24'. The closure 24' also includes a central portion 28', toggle portion 30' and tab 38'.

Figure 12:
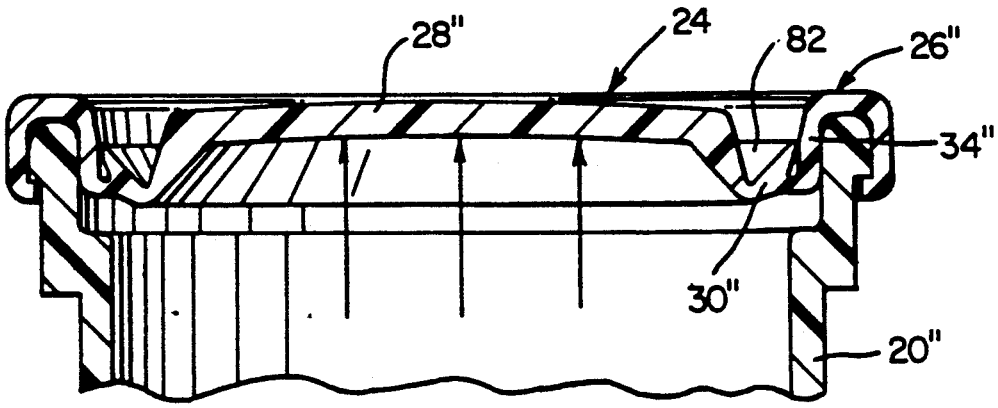
FIG. 12 is a side elevation in section of a second alternate embodiment of the invention.

Another embodiment of the invention is shown in FIG. 12. In that embodiment, a closure 24" includes a disk-shaped central portion 28" and a toggle portion 30" having a raised, annular rib 82 which is wedge-shaped in cross section. When the central portion 28' is deflected upwardly by internal pressure within the container 20", the wedge portion 82 pivots radially outwardly to contact the inner wall 34" of the rim portion 26" and effect a seal.

Figure 13:
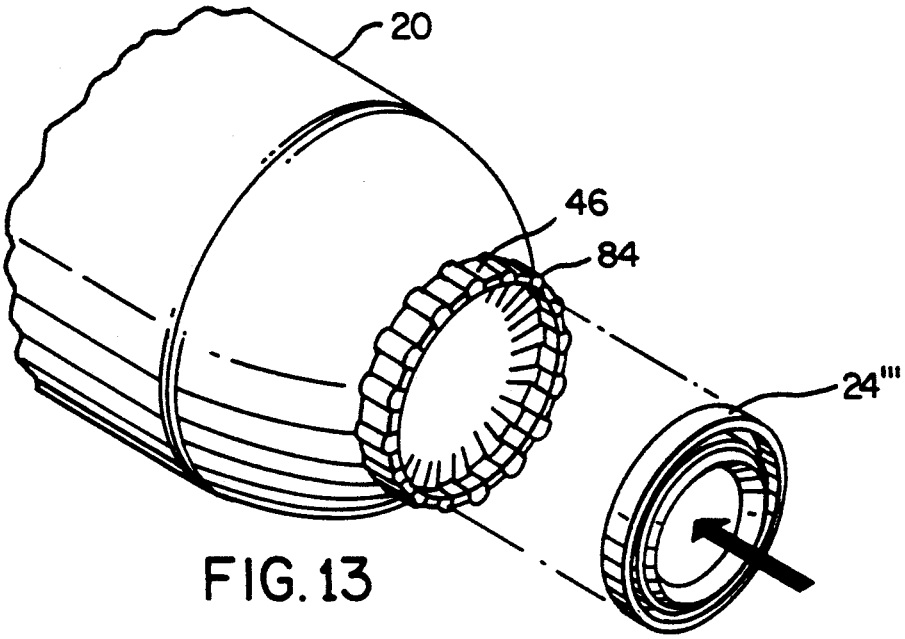
FIG. 13 is a perspective view of the bottom of the container of the present invention in which the closure is exploded away from the base.
Figure 14:
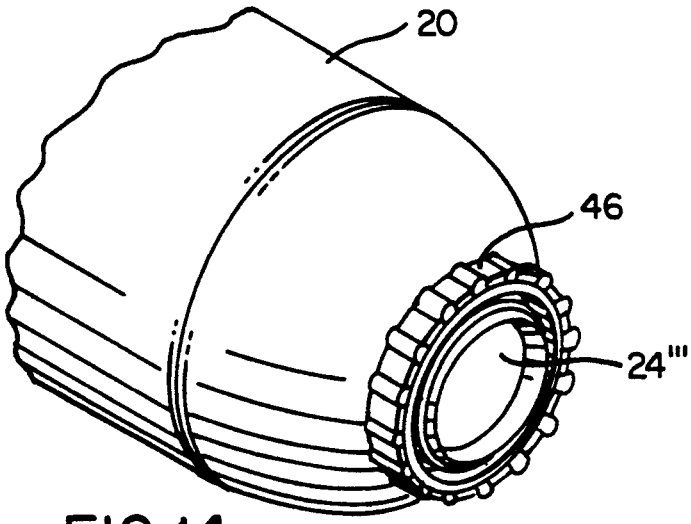
FIG. 14 is a perspective view in which the closure is received within the base of the container of FIG. 17.

As shown in FIGS. 13 and 14, the base 46 is annular in shape and is sized to receive a closure 24''' therein. The closure 24''' shown in FIGS. 13 and 14 lacks a tab. However, a tab could be provided and the base 46 notched to receive it. Accordingly, when removed from the mouth of the container 20, the closure 24''' can be inserted into the base 36 and retained so that the combination can be disposed of properly. The base 46 includes a plurality of ribs 84 which extend radially inwardly slightly, and provide a slight interference fit with the closure 24'''.

While the forms of apparatus herein described constitute preferred embodiments of this invention, it is to be understood that the invention is not limited to these precise forms of apparatus, and that changes may be made therein without departing from the scope of the invention.

What is claimed is:

1. A container and pressure-sealing closure combination comprising:

a container having an annular mouth; and a closure shaped to cover said mouth;

said mouth having means for conducting pressurized gaseous contents of said container to the ambient between said closure and said container;

said closure having a rim portion engaging said mouth, a substantially rigid central portion, and an annular toggle portion pivotally connected to and interconnecting said rim portion and said central portion at distinct relatively thin hinge locations, whereby upward movement of said central portion in response to internal pressure from contents of said container pivots said toggle portion to urge said rim portion substantially radially outwardly against said mouth, thereby effecting a seal.

2. The combination of claim 1 wherein said rim portion includes an inner wall, abutting an inner face of said mouth; an outer wall, abutting an outer face of said mouth; and a top wall, extending between said inner and outer walls and adjacent to an end of said mouth.

3. The combination of claim 2 wherein said toggle portion is connected to and urges against said inner wall of said rim portion.

4. The combination of claim 3 wherein said inner face tapers radially inwardly toward said end, whereby said inner wall is prevented from sliding toward said end when said closure effects a seal.

5. The combination of claim 4 wherein said inner wall is tapered radially inwardly toward said top wall, corresponding to said taper of said inner face.

6. The combination of claim 1 wherein said toggle portion includes a wedge portion, whereby upward movement of said central portion pivots said wedge portion radially outwardly against said rim portion, thereby enhancing said seal.

7. The combination of claim 1 wherein said container includes a base; and said closure is shaped to be retained in said base subsequent to removal from said mouth.

8. The combination of claim 1 wherein said container and closure are made of polyethylene terephthalate.

9. A container and pressure-sealing closure combination comprising:

a container having an annular mouth;

a closure shaped to cover said mouth and having a rim portion engaging said mouth, a substantially rigid central portion, and an annular toggle portion pivotally connected to and interconnecting said rim portion and said central portion at distinct relatively thin hinge locations, whereby upward movement of said central portion in response to internal pressure from contents of said container pivots said toggle portion to urge said rim portion substantially radially outwardly against said mouth, thereby effecting a seal;

said rim portion includes an inner wall, abutting an inner face of said mouth; an outer wall, abutting an outer face of said mouth; and a top wall, extending between said inner and outer walls and adjacent to an end of said mouth;

said toggle portion is connected to and urges against said inner wall of said rim portion;

said inner face tapers radially inwardly toward said end, whereby said inner wall is prevented from sliding toward said end when said closure effects a seal;

said inner wall is tapered radially inwardly toward said top wall, corresponding to said taper of said inner wall; and said inner face includes means for conducting pressurized gaseous contents of said container to the ambient between said closure and said container.

10. The combination of claim 9 wherein said means for conducting pressurized gaseous contents to the ambient includes a plurality of channels spaced about an inner surface of said inner face.

11. The combination of claim 9 wherein said inner wall contacts said inner face at an annular seal area spaced from said channels.

12. The combination of claim 10 wherein said outer face includes an annular recess adjacent said end; and said outer wall includes a rib for engaging said recess, whereby said engagement retains said closure on said mouth.

13. The combination of claim 12 wherein said closure includes a tab projecting outwardly therefrom and positioned such that displacement of said tab relative to said mouth to form said closure sufficiently to break said seal.

14. The combination of claim 13 wherein said tab is adjacent to at least a portion of said rib.

15. The combination of claim 13 wherein said closure includes a frangible component, activated by pivoting said tab relative to said closure, such that when said frangible component is activated, reattachment of said closure to said container mouth is prevented.

16. The combination of claim 15 wherein said frangible component includes a plurality of generally radially-extending slots formed in said rim portion.

17. The combination of claim 15 wherein said slots are grouped in pairs, said pairs being spaced about said rim portion.

18. The combination of claim 16 wherein a first pair of said slots is positioned on said rim portion adjacent to said tab means.

19. The combination of claim 17 wherein said slots are formed in said outer wall and said top wall.

20. A container and pressure-sealing closure combination comprising:

a container having an annular mouth;

a closure shaped to cover said mouth and having a rim portion engaging said mouth, a substantially rigid central portion, and an annular toggle portion pivotally connected to and interconnecting said rim portion and said central portion, whereby upward movement of said central portion in response to internal pressure from contents of said container pivots said toggle portion to urge said rim portion substantially radially outwardly against said mouth, thereby effecting a seal;

said rim portion includes an inner wall, abutting an inner surface of said mouth; an outer wall, abutting an outer surface of said mouth; and a top wall, extending between said inner and outer walls and adjacent to an end of said mouth;

said toggle portion is connected to and urges against said inner wall of said rim portion;

said inner face tapers radially inwardly toward said end, whereby said inner wall is prevented from sliding toward said end when said closure effects a seal;

said inner face includes means for conducting pressurized gaseous contents of said container to the ambient between said closure and said container;

said means for conducting pressurized gaseous contents to the ambient includes a plurality of channels spaced about an inner surface of said inner face;

said outer face includes an annular recess adjacent said end; and said outer wall includes a rib for engaging said recess, whereby said engagement retains said closure on said mouth;

said closure includes a tab projecting outwardly therefrom and positioned such that displacement of said tab relative to said mouth deforms said closure sufficiently to break said seal;

said closure includes a frangible component, activated by pivoting said tab relative to said closure, such that when said frangible component is activated, reattachment of said closure to said container mouth is prevented;

said frangible component includes a plurality of generally radially-extending slots formed in said rim portion; and wherein a first pair of said slots is positioned on said rim portion adjacent to said tab and a second pair of said slots is positioned on said rim portion opposite said tab.

21. The combination of claim 20 wherein third and fourth pairs of said slots are positioned on said rim portion approximately 77′ on either side of said second pair of said slots.

22. A container and pressure-sealing closure combination comprising:

a container having an annular mouth;

a closure shaped to cover said mouth and having a rim portion engaging said mouth, a substantially rigid central portion, and an annular toggle portion pivotally connected to and interconnecting said rim portion and said central portion, whereby upward movement of said central portion in response to internal pressure from contents of said container pivots said toggle portion to urge said rim portion substantially radially outwardly against said mouth, thereby affecting a seal;

said toggle portion includes a wedge portion, whereby upward movement of said central portion pivots said wedge portion radially outwardly against said rim portion, thereby enhancing said seal; and said wedge portion is annular in shape and projects upwardly and radially outwardly from said toggle portion.

23. The combination of claim 7 wherein said base includes an annular ring shaped to receive said closure in an interference fit.

24. A container and pressure-sealing closure combination comprising:

a container having an annular mouth; and a closure shaped to cover said mouth;

said container having means for conducting pressurized gaseous contents of said container to the ambient between said closure and said container;

said closure having a rim portion engaging said mouth, said rim portion having a plurality of generally radially-extending slots, said slots forming a frangible portion such that removal of said closure from said mouth fractures said closure along said slots thereby preventing reattachment of said closure to said mouth.

25. The combination of claim 24 wherein said rim portion includes an inner wall, an outer wall and a top wall, extending between said inner and outer walls and adjacent to an end of said mouth; said slots being formed in an underside of said outer wall and an underside of said top wall.

26. The combination of claim 25 wherein said slots are grouped in pairs, said pairs being spaced about said rim portion.

27. The combination of claim 24 wherein said container and closure are made of polyethylene terephthalate.

* * * * *